US007704153B2

(12) United States Patent
Loh et al.

(10) Patent No.: US 7,704,153 B2
(45) Date of Patent: Apr. 27, 2010

(54) GOLF SWING TRAINER

(76) Inventors: Cheng Wah Loh, 8818 Emperor Ave., San Gabriel, CA (US) 91775; Yini Wu, 970 Medford Rd., Pasadena, CA (US) 91107

( * ) Notice: Subject to any disclaimer, the term of this patent is extended or adjusted under 35 U.S.C. 154(b) by 0 days.

(21) Appl. No.: 11/895,662

(22) Filed: Aug. 27, 2007

(65) Prior Publication Data

US 2008/0064519 A1 Mar. 13, 2008

Related U.S. Application Data

(60) Provisional application No. 60/843,777, filed on Sep. 11, 2006.

(51) Int. Cl.
*A63B 69/36* (2006.01)

(52) U.S. Cl. ..... 473/221; 473/219; 473/148

(58) Field of Classification Search ..... 473/139, 473/140, 147, 148, 149, 151, 198, 221, 222, 473/225; 273/149 R
See application file for complete search history.

(56) References Cited

U.S. PATENT DOCUMENTS 3,601,408 A * 8/1971 Wright ..... 473/225
3,895,366 A * 7/1975 Morris ..... 340/870.26
4,304,406 A * 12/1981 Cromarty ..... 473/225
4,958,836 A * 9/1990 Onozuka et al. ..... 473/141
5,718,639 A * 2/1998 Bouton ..... 473/151
5,976,022 A * 11/1999 Williams ..... 473/151
6,227,984 B1 * 5/2001 Blankenship ..... 473/221
6,261,189 B1 * 7/2001 Saville et al. ..... 473/221
6,554,716 B1 * 4/2003 Loh et al. ..... 473/148
6,821,211 B2 * 11/2004 Otten et al. ..... 473/219
7,329,193 B2 * 2/2008 Plank, Jr. ..... 473/221

* cited by examiner

*Primary Examiner*—Nini Legesse
(74) *Attorney, Agent, or Firm*—Clement Cheng

(57) ABSTRACT

A golf swing assistance device has a base having a flat upper surface with a hitting spot, a shallow lower surface indented adjacent to a hitting spot of the upper surface. The hitting spot is located in the middle of a golf swing that a user takes. A rear position sensor is located behind the golf swing, and behind the hitting spot. A front position sensor is located after the swing and in front of the hitting spot. A ball holder has a ball holding plate, a ball holding arm and a ball holder connector. A block receives the ball holder connector. An adjusting mechanism allows vertical adjustment of the ball holder connector. A ball target has a ball end, a ball target arm and a ball target connector. Also, position sensors mounted on stands can monitor other sections of the golf swing.

12 Claims, 5 Drawing Sheets

GOLF SWING TRAINER

This application claims domestic priority from provisional application 60/843,777 having a filing date of Sep. 11, 2006.

BACKGROUND OF THE INVENTION

1. Field of the Invention

This invention relates generally to the field of apparatus for a golf training, practice, and coaching device.

2. Discussion of Related Art

A variety of golf assistance devices had been invented. For example, Golf 'Swing For Accuracy' Mat U.S. Pat. No. 6,554,716 patented Apr. 29, 2003 shows a device having a mat and a pair of connecting arms holding ball targets that assist the user in improving a golf swing. The disclosure of U.S. Pat. No. 6,554,716 is incorporated herein by reference.

SUMMARY OF THE INVENTION

The invention is an apparatus for teaching and practicing a golf swing. The major parts of the apparatus include a microprocessor, a display, a ball holder, a ball holding cup component an orientation sensor, and three or more linear position sensors. Also, a display having LED feedback alone without a microprocessor may be cheaper and have a market advantage. The orientation sensor detects how straight the golf club travel is and consequently the golf club face orientation during impact, while the position sensors, working together, detect the path and position of the club head. The microprocessor takes the information given by the sensors and sends the information to the display. The goal of the user is to find the perfect curve through practice on the driving range as defined by the positions of the sensors and place the sensors on three points or more of the said curve. The apparatus may be used in conjunction with the device of U.S. Pat. No. 6,554,716, the disclosure of which is incorporated herein by reference. The ball holder preferably holds a ball so that the user can use the ball holder to avoid dislodging the ball while hitting the practice ball target below.

The device consists in general of an orientation sensor, some position sensors and movable ball holding component. A special movable elastic plastic portion has a ball holding plate and ball holding arm and ball holding cylinder connector components similar to the ball holding component in U.S. Pat. No. 6,554,716 entitled "Swing For Accuracy". The present invention includes a movable hollow cylinder connector attached to the ball holding plate and ball holding arm to allow the ball holder to move up and down vertically inside the block. The ball holding plate is supported by a ball holding component 35 comprising a cylindrical rubber or plastic cup 32 which is partially sitting inside a cylindrical cup holder 31 and on top of a metal spring located at the bottom of the cup holder whose height is adjustable. The ball holding component 35 is inserted into a base 11.

Two position sensors are placed on both sides of and preferably no more than a few inches away from the golf ball which is sitting on the vertically movable and adjustable elastic plastic or rubber ball holding cup at the proper position waiting to be hit. These two position sensors and the golf ball are sitting along a straight line connecting the target to the golf ball to form the so called target line. The two sensors are also properly positioned so that when the club head passes along and right above of the target line, it will also pass above the two position sensors before and after making contact with the ball. The two position sensors can be moved along the target line on both sides of the golf ball so that when the club head passes right above each position sensor, the distance between the club head and each position sensor will be within the sensing distance of each sensor and each position sensor will be triggered in sequence.

When a sensor is triggered it will light up an LED on the LED display of a special color corresponding to that sensor for a short instant to indicate that that club head is right above that sensor at that moment. Regarding the colors, it would be obvious to have green signify a good stroke, yellow a marginal stroke, and red a poor stroke. The positions of the two position sensors are closely associated with the curve or path traced by the club head and thus a major factor in determining the projectile of the golf ball in that particular swing. If the user hits a good shot with a particular position set up or arrangement of the position sensors around the golf ball at the driving range with both position sensors triggered and the corresponding LEDs lighting up, the user can record the position of each sensor for further analysis. Once the user has a swing with the same set up or arrangement of the sensors with respect to the golf ball, the user can practice the same stroke for muscle memory. The third position sensor mounted on a post is added to locate the club head in some special section of the swing such as at the beginning or ending of the swing to help define the curve of the golf swing with one more data point. If more data points are needed, more position sensors mounted on post stands will be used to detect other points on the swing curve.

A wide variety of sensors are known in the art and do not need to be described in detail here. A wide variety of sensors can be used with this application including a position sensor that uses any type of light beam or irradiation source and a reflector such as a photoelectric, laser, infrared or related position sensors. Three different sizes of reflectors are attached to various spots on the club heads to provide different sensitivities, such as for the sensor with the smallest reflector having the highest sensitivity. The definition of highest sensitivity means the club head is closest to the space right above the sensor. The orientation sensor is used to measure how square the club head face is with respect to the target line at the moment the club head meeting the golf ball. The LED connected to the orientation sensor will light up if the deviation of the normal of the club head face with respect to the target line is within a preset value.

Another practice routine which is very helpful for a successful stroke is to try to swing the club head to make contact with a properly positioned elastic plastic ball holding plate in the vertically movable elastic plastic ball holder component. The position of the so called properly positioned elastic ball holding plate is located a slightly lower than the edge of the platform which is located a tiny bit to the right side of the golf ball or ball holding plate for a right handed golfer. In this exercise the left tip of the ball holding plate is barely exposed to and touchable by the club head in the swing. If the golfer can swing the club head clear of the edge of the platform and to make contact with the left edge of the elastic plastic ball holding plate which is properly sitting lower than the edge in every swing, the golfer is having very good control of the contacting spot of the club head with respect to the golf ball.

OBJECTS OF THE INVENTION

A principal object of the present invention is to provide a golf training, practice and coaching device that will overcome the deficiencies of the prior art devices.

An object of the present invention is to provide a golf training, practice, and coaching device that will show a user how square the club head face with respect to the target line thereby connecting the golf ball and the target at the moment the club head is impacting the golf ball. It allows the user to modify the swing accordingly if the deviation is greater than a preset value and the orientation sensor LED is not lighted up.

An object of the present invention is to provide a golf training, practice, and coaching device that will determine the form of the curve traced by the club head which triggers a few position sensors placed around the golf ball and near other segments of the curve such as the beginning or ending of the curve. If the position arrangement of the sensors is made correctly such as one made by a golf coach, the student's swing curve will change accordingly to trigger all the position sensors and the projectile of the golf ball will probably improve as a result. If the position sensor used is the beam source and reflector type, the sensitivity of the sensor is related to the size of the reflector. Three sizes of reflector will be used with the smallest size having the highest sensitivity and largest size with the lowest sensitivity. When the smallest size reflector triggers the sensor, the club head is moving pretty closely above the target line around the golf ball and produces a swing pretty close to the one by design.

An object of the present invention is to provide a golf training, practice, and coaching device that will help the golfer practice the swings which the club head makes contacts with the golf ball at the same spot repeatedly. This is done by properly selecting the height difference between the ball holding plate of the movable elastic plastic ball holder component and the surface of the platform so that the left tip of the ball holding plate is barely exposed to and touchable by the club head assuming the ball holding plate is placed very close to the platform horizontally.

Another object of the present invention is to provide a golf training, practice, and coaching device that will roughly measure the speed of the club head shortly before meeting the ball and after meeting the ball. The comparison of the time period between signal from the first sensor (the sensor on the right side of the ball for right handed player) and the signal from the orientation sensor when club head meeting the ball with the time period between the orientation sensor signal and the signal from the second sensor (the sensor on the left side of the ball for right handed player) will make you realize sometimes a smooth and easy down swing (especially at the beginning of the down swing) will produce more power and longer distance. A couple more position sensors mounted on the post stands will help monitor the club head path at the beginning of the down swing and provide more speed information regarding the earlier section of the down swing.

Another object of the present invention is to provide a golf training, practice, and coaching device that is more universally functional in today's market than the prior art devices.

DETAILED DESCRIPTION OF THE PREFERRED EMBODIMENT

A golf swing assistance device has a base having a flat upper surface with a hitting spot and, a shallow lower surface indented adjacent to a hitting spot of the upper surface. The hitting spot is located in the middle of a golf swing that a user takes. A rear position sensor is located behind the golf swing, and behind the hitting spot. A front position sensor is located after the swing and in front of the hitting spot. A ball holder has a ball holding plate, a ball holding arm and a ball holder cylinder connector. A block receives the ball holder cylinder connector. An adjusting mechanism allows vertical adjustment of the ball holder cylinder connector. A ball target has a ball end, a ball target arm and a ball target connector.

Figure 1:
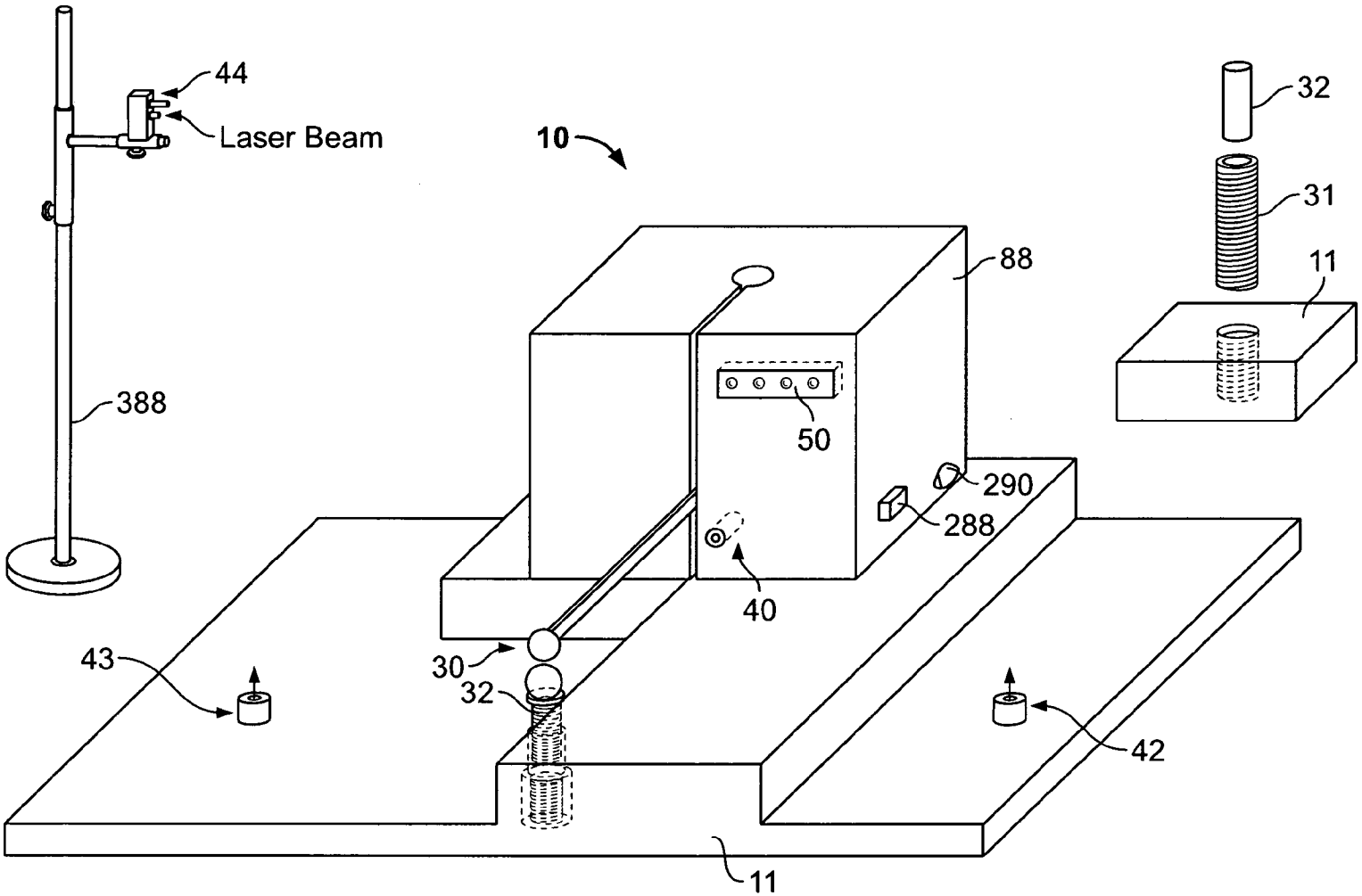
FIG. 1 is a diagram of components showing the configuration where the golf ball being hit is below the golf ball holder.

Referring now descriptively to the drawings, the attached figures illustrate a training, practice, and coaching device. FIG. 1 shows the general components for the golf training and practicing device 10. It includes a vertically movable ball holder component 30, a ball holding cup component 35, an orientation sensor 40 in the block, two position sensors 42, 43 sitting on the base, a third position sensor 44 attached to a post stand for detecting any other point on the curve of the swing, and an LED display 50. FIG. 1 is a diagram of the electronic and mechanical components for the golf training, practice, and coaching device according to the present invention with a vertically movable ball holder, a ball holding cup component 35, an orientation sensor in the block, two position sensors sitting on the base and a third position sensor attached to a post for detecting any other point on the curve of the swing.

Figure 2:
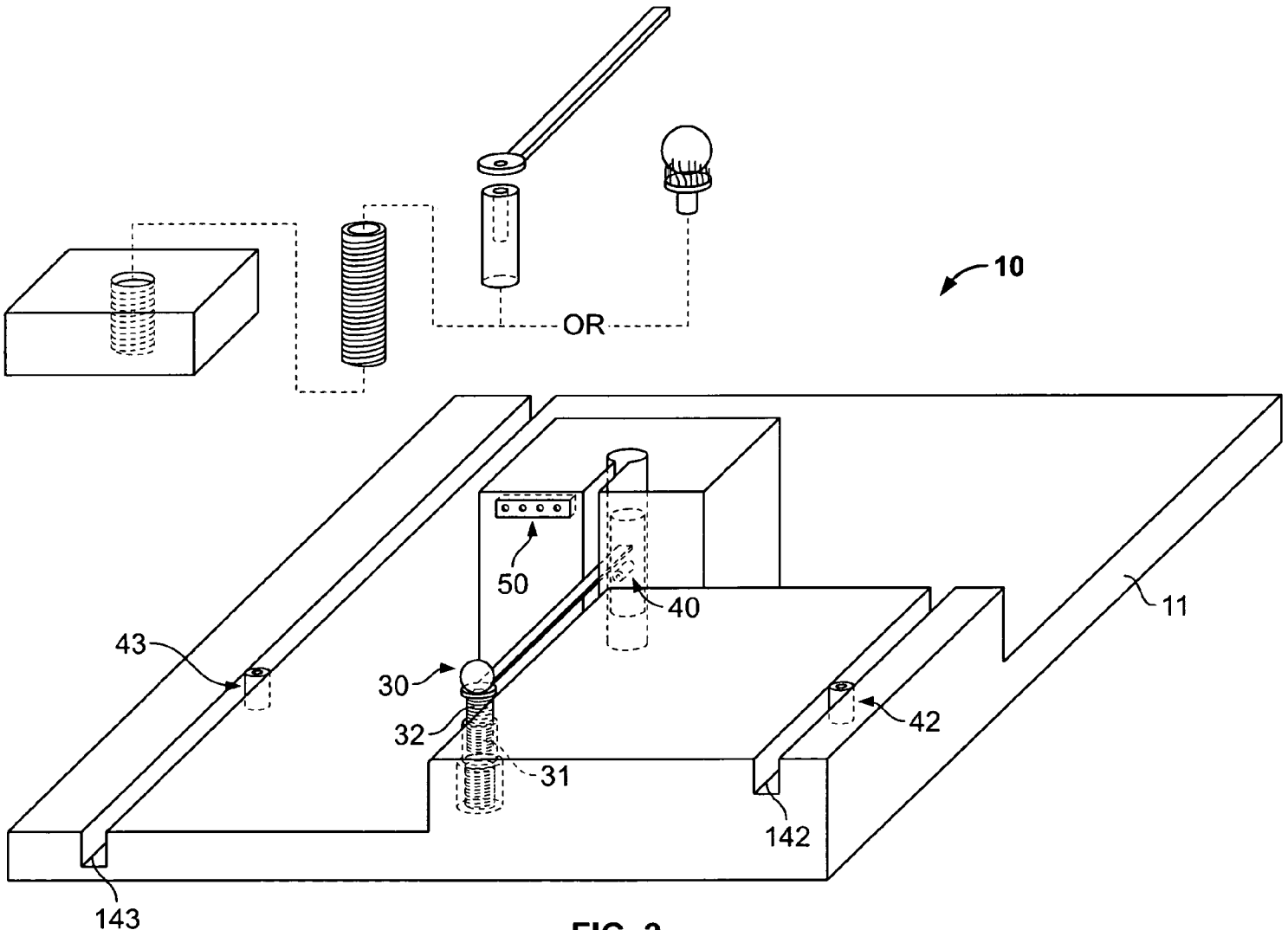
FIG. 2 is a diagram of components showing the configuration where the golf ball is placed on the golf ball holder for a user to hit.

FIG. 2 illustrates the various components of the device. FIG. 2 is a diagram of the electronic and mechanical components for the golf training, practice, and coaching device according to the present invention with the vertically movable ball holder having an elastic plastic ball holding plate, arm and cylinder connector components, a ball holding cup component, an orientation sensor mounted within the block and two position sensors hidden inside two grooves out of reach of the club head. FIG. 2 is a diagram of components showing the configuration where the golf ball is placed on the golf ball holder for a user to hit. This configuration is different than the configuration of FIG. 1 where the golf ball holder is holding a golf ball above the golf ball that the user is trying to hit. The configuration of FIG. 1 thus has a golf ball that the user is trying to hit below the golf ball that the user is trying not to disturb.

The major pieces displayed include vertically movable elastic plastic ball holder 30 component, a ball holding cup component 35, an orientation sensor, two position sensors and an LED display. The orientation sensor detects how square the golf club face will be with respect to the target line at impact. The position sensors, working together, detect the path of the club head at two points where the position sensors will be triggered in the curve traced by the club head. The two position sensors are mounted in slots formed as a pair of grooves located close enough to the ball holding plate so that they will be triggered as the golf club head passes over each sensor. A front slot 142 retains the front position sensor 42. A rear slot 143 holds rear position sensor 43.

The mechanical components of the device consist of a vertically movable elastic plastic ball holder 30. The ball holder 30 holds the ball. The ball holder 30 is comprised of a ball holding plate mounted on a ball holding arm attached to a ball holder cylinder connector. A cup holder 31 provides vertical support to a cup 32 or other type of surface designed to support the ball holding plate to maintain a consistent height for ball striking. The cup 32 also provides an alternate means for supporting the ball without the ball holder 30.

The ball holder 30 may rest upon a cup 32 sitting on the with metal spring inside the cup holder 31 which functions as a cushion. Thus, the cylindrical portion of the cup holder 31 preferably has external machine screw threads on an outer surface to retain the cylindrical portion of the cup holder 31 within a cylindrical hole formed in the base 11. A cylindrical hole inside the base 11 has internal machine threads on the inside wall surface of the hole so that the cup holder 31 can be adjusted and moved up and down inside the cylindrical hole by user manual rotation of the cylindrical cup holder 31 inside the cylindrical hole formed in the base.

As seen in FIG. 1, a cylindrical rubber cup 32 may function alone as a ball holder and replace the ball holding plate and plastic cup, as seen in FIG. 2, to serve the same function as those two parts combined. Also, a plastic grass ball holder may insert in the plastic or rubber cup 32 while holding the golf ball on top. The ball holder 30 comprising the ball holding plate, arm and cylinder connector 133 may be raised slightly so that the ball holding plate is almost level with the platform edge on the right side. With a ball holding plate holding a golf ball, the device 10 ready for a practice swing.

Figure 3B:
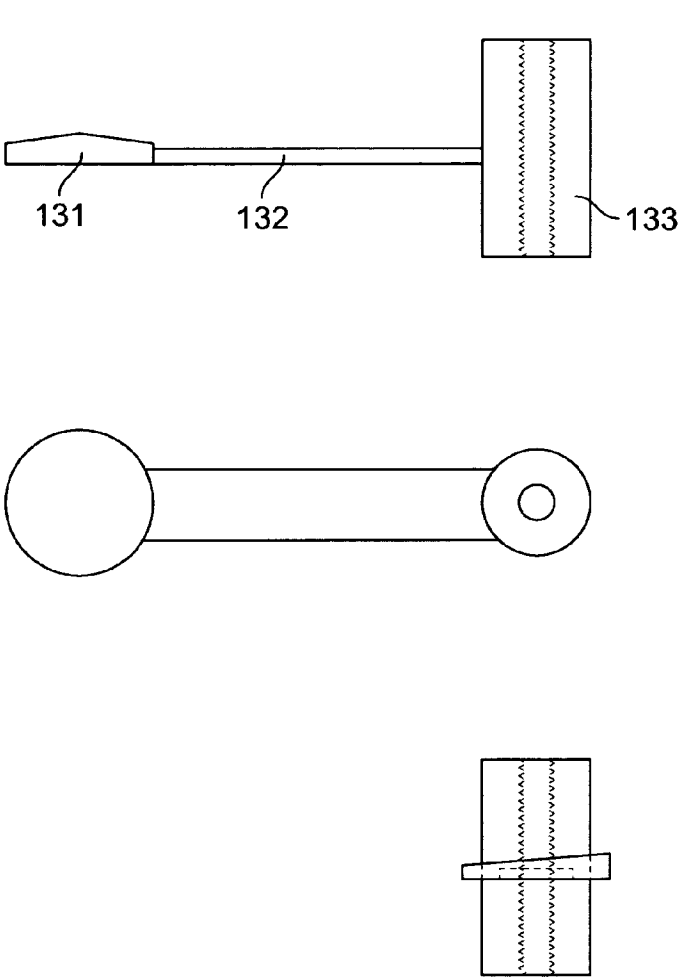
FIG. 3 is a diagram of two different styles of the golf ball holder.
Figure 3A:
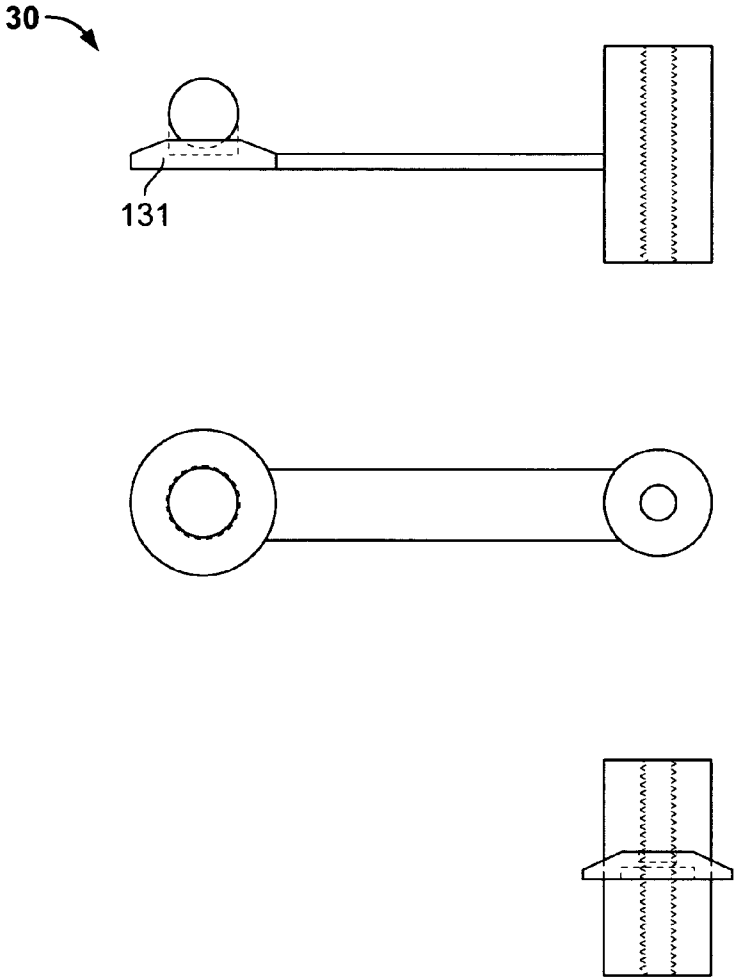

FIG. 3 is a diagram of the ball holding plate, arm, and cylinder connector mechanical component for the golf training, practice, and coaching device according to the present invention. FIG. 3 shows a diagram of the ball holder 30 that includes the ball holding plate 131, ball holder arm 132 and cylinder connector 133 component with two different shapes of the ball holding plate 131. The ball holding plate in FIG. 3*a* has a shallow round hole in the center of the round plate to hold a golf ball. The ball holding plate in FIG. 3*b* has the shallow round hole removed so that it is not used to hold the golf ball. Instead the ball holding plate 131 in the alternative embodiment comprises a round plate with a sloping top surface for sensing clubhead strike. The sloping surface on the round plate is designed for force reduction from impact of the club head on the round plate. When the ball holding plate with sloping surface is located at a properly calculated height, which is a little lower than the platform edge located close to the right side of the plate, only a very small portion on the left tip of the round plate is exposed to and touchable by the swinging club head. When the club head is swinging a little bit lower, it will hit the edge of the platform and miss the ball holding plate. When the club head is swinging a little higher, it will fly over and miss the holding plate. Only when the club head swings constantly at a certain height of a very narrow margin, will it clear the edge of the platform and make contact with a tiny portion of the left tip of the ball holding plate. Only when the golfer can hit the left tip of the sloping surface repeatedly without touching the edge of the platform, can the golfer swing the club at the same height repeatedly and meet the ball at the same spot constantly. FIG. 3 is a diagram of the structure of the ball holder structure 30 and it does not have the proper proportional scale and does not have the same proportional scale as the one in the diagram of FIG. 2. The different embodiments of the ball holder structure 30 can be manually interchanged by removing the ball holder from the ball holder slot. Because different arm members can be inserted into the base block 88 portion, the user can use the modular nature to create a variety of different combinations.

Figure 4:
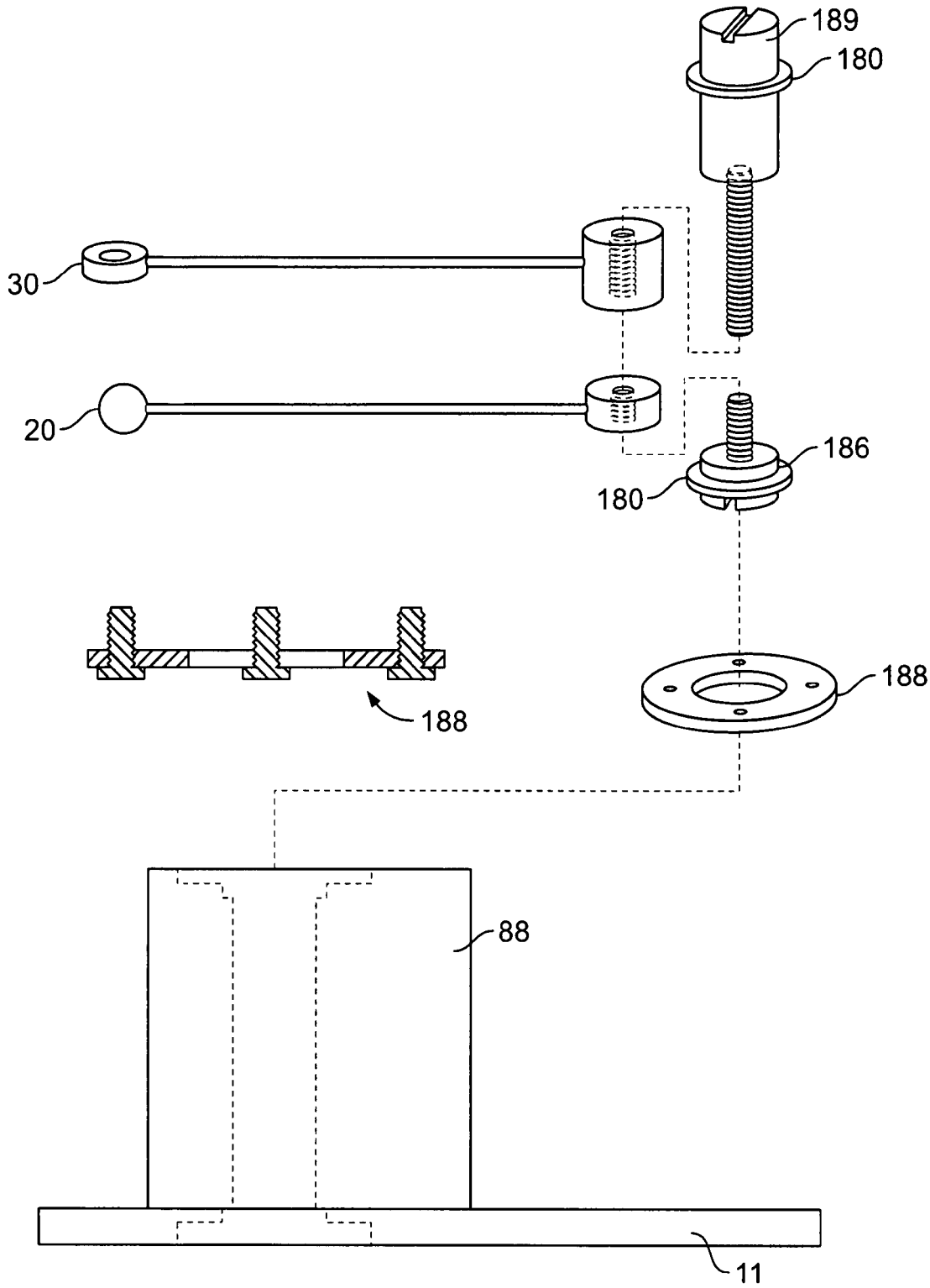
FIG. 4 is an exploded view diagram of the parts for the mechanical components.
Figure 5:
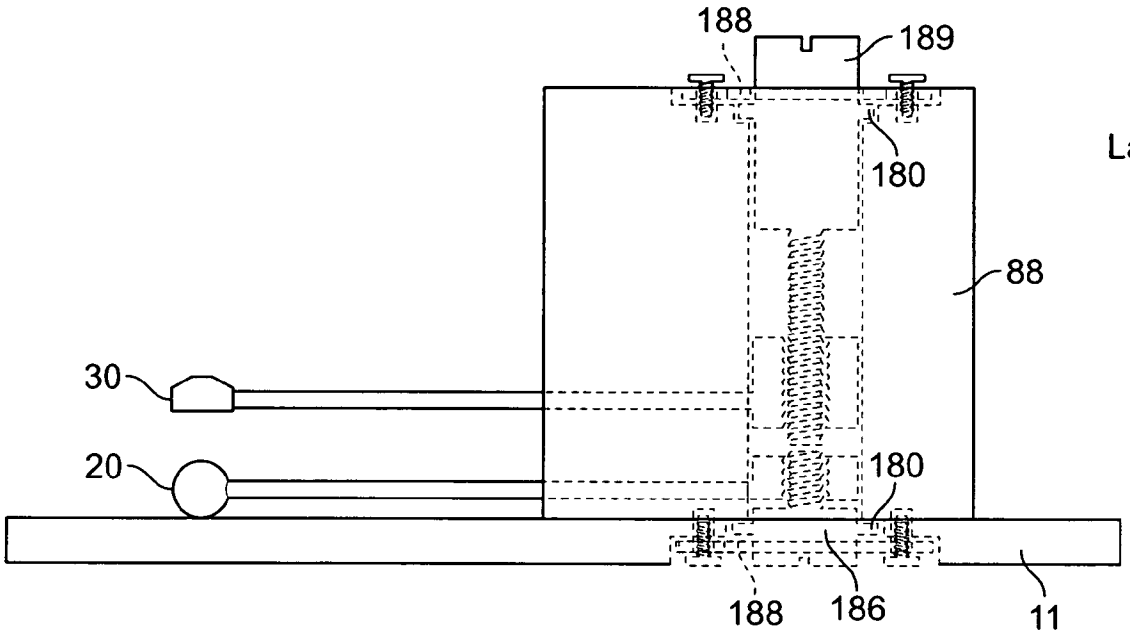
FIG. 5 is a diagram of the assembled mechanical components.

FIG. 4 is an exploded view diagram of the mechanical parts for the block 88 and mat or base 11 giving instruction as to how to assemble the various mechanical parts. FIG. 5 is a side cross-section view of the block 88 and base 11 parts as assembled.

The block portion 88 can be made of a number of different materials such as wood, plastic or metal. The block portion 88 is shaped as a rectangular square piece for simplicity of illustration only and in actual implementation would probably be designed to have a more appealing exterior shape. The block portion 88 is mounted to base 11. The block portion 88 receives a retaining bracket 188 that is annular having screw holes. The annular retaining bracket 188 secures to the bottom of the block 88 and to the top of the block 88. The bottom plug 186 has a slot receiving a screwdriver for adjustment or disassembly. The bottom plug 186 has a threaded portion above the lower plug portion. The lower plug portion has a collar 180 that is retained against the annular retaining bracket 188. The upper plug portion 189 also has a threaded portion below the plug portion. The upper plug portion 189 also has a collar 180 that is retained against the annular retaining bracket 188. The ball holder 30 has a hole to receive a golf ball. Below the ball holder 30 is a practice ball target 20.

During use, a user may hit the ball target 20 while trying to avoid the ball holder 30. A user may put a golf ball in the ball holder 30 and try to hit the ball target 20 without dislodging the golf ball from the ball holder 30. Alternatively, the user may reverse the ball target 20 with the ball holder 30 so that the user tries to avoid the ball target 20 which is above the ball holder 30 while still trying to hit the ball on the ball holder 30. The rotation of the top plug portion 189 raises and lowers the ball holder 30 portion. The rotation of the bottom plug 186 raises and lowers the practice ball target 20. The parts held within the block portion 88 are substantially coaxial, vertically oriented and of similarly threaded orientation. The mechanism used to move the top ball holder component up and down allows the distance gap between the top ball target or ball holder and the mat surface to be slightly greater than the height of the club head for allowing club head passage.

Figure 6:
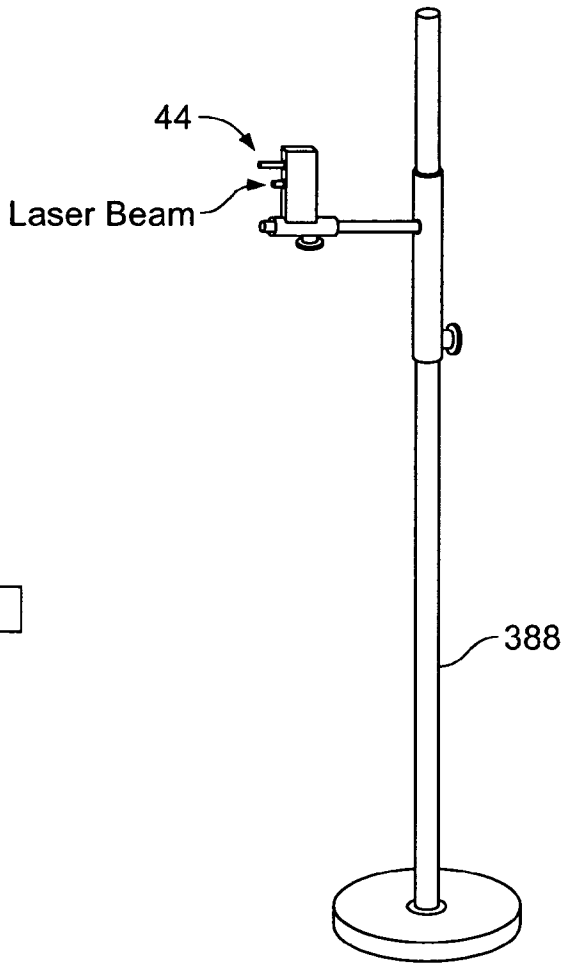
FIG. 6 is a diagram of the stand holding a position sensor.

FIG. 6. is a diagram of the electronic and mechanical components for a three dimensionally movable position sensor connected to a post so that the sensor can monitor any other point in the path the club head such as the beginning or finishing position of the club head. The laser beam will help locate the position of the club head and make the set up easier. The stand can be placed in a variety of locations such as in the follow-through swing area. A couple of stands can also be placed on the downswing area before the clubhead meets the ball so as to monitor the clubhead's speed in the earlier section of the downswing.

A microprocessor 288 can be located within the block portion if the block portion 88 is formed as a housing. The microprocessor or CPU is preferably formed as a circuit such as an integrated circuit that processes the inputs of the sensor readings to provide an audible or visual LED display feedback for the user.

The electronic portion of this device includes an orientation sensor 40, several linear position sensors 42, 43, 44, a microprocessor 288, a digital display 50 and sound output devices such as speakers 290. Two linear position sensors 42, 43 are placed on both sides of and a few inches away from the golf ball, which is sitting on a rubber cup waiting to be hit. These two linear position sensors 42, 43 are oriented approximately in a straight line drawn from the target to the golf ball. The two sensors form an arc properly positioned so that if the club head passes right above the sensors before and after the contact with the ball, the distances between the club head and the two sensors will be within the sensing distance of the sensors. The sensors will be triggered by the club head. When a sensor is triggered it will send a signal to the microprocessor and set off an alarm or send some information to the display.

The motion sensors can also be moved within slots. If the front sensor 42 and the rear sensor 43 are almost in a straight line orientation, the positions of the sensors will sense the club head when a particular swing is made.

Therefore, during an actual game, a user may remember the particular swing that the user wants to practice. The user may then arrange the sensors to simulate the particular swing. The user can then practice with the particular set up or arrangement of the sensors so that the same stroke can be reproduced in the next golf game from the muscle memory.

The extra third linear position sensor mounted on a post stand 388 is added in special cases such as to locate the club head position at the beginning or ending of the swing to help define the curve of the golf swing. The orientation sensor is used to measure how square the club head is with respect to the target or target line when the club head meets the golf ball. A signal is also sent from the orientation sensor to the microprocessor 288 to give the information about the orientation of the club head face to be displayed if needed. The microprocessor measures the time between the signal from the first sensor 42, and the signal from the orientation sensor 40 sent when club head meets the ball. The microprocessor also measures the time between the signal from the first sensor 42 and the time when the signal from the second sensor 43 and display the data on the display board.

Preset criteria determine the optimal swing for the club head times at the first position sensor 42, the second position sensor 43 and the orientation sensor 40 at the ball. If the stroke timing data matches with the tolerances defining the bounds for a good stroke, the central processing unit microprocessor 288 gives an "OK" voice response or other type of visual cue display to indicate a good stroke when all the sensors are triggered and the deviation of the club face is within a preset value in a swing. Optionally, the speaker portion 290 can produce an individual different musical note when each linear position sensor is triggered, another different musical note when the deviation of the club head face is within a preset value. The player could repeat the swing or the musical notes when the feedback signals are sent to the microprocessor show that everything is well done.

The invention claimed is:

1. A golf swing assistance device comprising:

a. a base having a flat upper surface with a hitting spot, a shallow lower surface indented adjacent to a hitting spot of the upper surface;

b. a rear position sensor located behind the golf swing, and behind the hitting spot, wherein the rear position sensor is located in a rear position sensor slot, wherein the rear position sensor slot is elongated in a direction toward and away from a user;

c. a front position sensor located after the swing and in front of the hitting spot, wherein the front position sensor is located in a front position sensor slot, wherein the front position sensor slot is elongated in a direction toward and away from a user;

d. an orientation sensor approximately located at the hitting spot;

e. a ball holder having a ball holding plate, a ball holding arm and a ball holder connector;

f. a block receiving the ball holder connector;

g. an adjusting mechanism allowing vertical adjustment of the ball holder connector;

h. a microprocessor receiving data from the rear position sensor, data from the front position sensor and data from the orientation sensor to process an output providing feedback to the user;

i. a post stand position sensor mounted on a post stand monitoring other sections of the golf swing;

j. a cup mounted on the base, and having vertically adjustable position mechanism to provide vertical support to the ball holder; and k. a ball target, wherein the ball target is mounted on a ball target arm which is connected to a ball target connector, wherein the ball target connector is connected to the block, wherein the ball target and the ball holder held by the block portion are substantially vertically oriented, further comprising a bottom plug that rotates to raise and lower the ball target, wherein the ball target and the ball holder held by the block portion are substantially vertically oriented, further comprising a top plug that rotates to raise and lower the ball holder, further comprising a cup mounted on the base, and having vertically adjustable position mechanism to provide vertical support to the ball holder, further comprising a ball target, wherein the ball target is mounted on a ball target arm which is connected to a ball target connector, wherein the ball target connector is connected to the block.

2. The golf swing assistance device of claim 1, further comprising a cup mounted on the base, and having vertically adjustable position mechanism to provide vertical support to the ball holder, wherein the block has a slot from which the ball holder protrudes, further comprising a ball target, wherein the ball target is mounted on a ball target arm which is connected to a ball target connector, wherein the ball target connector is connected to the block.

3. The golf swing assistance device of claim 2, wherein the ball target and the ball holder held by the block portion are substantially vertically oriented, further comprising a bottom plug that rotates to raise and lower the ball target.

4. The golf swing assistance device of claim 2, wherein the ball target and the ball holder held by the block portion are substantially vertically oriented, further comprising a top plug that rotates to raise and lower the ball holder.

5. The golf swing assistance device of claim 2, wherein the ball target and the ball holder held by the block portion are substantially vertically oriented, further comprising a bottom plug that rotates to raise and lower the ball target, further comprising a top plug that rotates to raise and lower the ball holder.

6. The golf swing assistance device of claim 5, wherein the output provides feedback to the user via a visual display and an audible signal.

7. The golf swing assistance device of claim 6, wherein the tip of the ball holding plate is barely exposed to a golf swing.

8. The golf swing assistance device of claim 6, wherein the ball target has a ball target connector that is substantially cylindrical fitting within a substantially cylindrical slot in the block and when the ball holder has a ball holder connector that is substantially cylindrical fitting within the substantially cylindrical slot in the block.

9. The golf swing assistance device of claim 6, wherein the ball holding plate is formed with a shallow round hole for holding a golf ball, wherein the ball holding plate is substantially round.

10. The golf swing assistance device of claim 6, wherein the ball holding plate has a sloping top surface.

11. The golf swing assistance device of claim 6, wherein the block portion is mounted to the base, wherein the block portion receives a retaining bracket that is annular in shape and having screw holes, wherein the retaining bracket secures to the bottom of the block and to the top of the block, wherein the bottom plug has a slot receiving a screwdriver for adjustment or disassembly, wherein the bottom plug has a threaded portion above a lower plug portion, wherein the lower plug portion has a collar that is retained against the annular retaining bracket.

12. The golf swing assistance device of claim 6, wherein the upper plug portion has a threaded portion below the plug portion, wherein the upper plug portion has a collar that is retained against an annular retaining bracket, wherein the upper plug portion has a thin threaded portion.

* * * * *